US007127907B2

(12) United States Patent
Tu

(10) Patent No.: US 7,127,907 B2
(45) Date of Patent: Oct. 31, 2006

(54) HEADGEAR CAPABLE OF SPRINKLING AND COOLING

(76) Inventor: Ming-Te Tu, PO Box 82-144, Taipei (TW)

( * ) Notice: Subject to any disclaimer, the term of this patent is extended or adjusted under 35 U.S.C. 154(b) by 209 days.

(21) Appl. No.: 10/996,399

(22) Filed: Nov. 26, 2004

(65) Prior Publication Data

US 2006/0112707 A1 Jun. 1, 2006

(51) Int. Cl.
*F25D 23/12* (2006.01)

(52) U.S. Cl. ..... 62/259.3; 62/259.4

(58) Field of Classification Search ..... 62/259.3, 62/259.4, 457.1, 457.2, 530; 165/46; 2/181, 2/195.1, 209.12, 209.13
See application file for complete search history.

(56) References Cited

U.S. PATENT DOCUMENTS 5,327,585 A * 7/1994 Karlan ..... 2/7
5,365,607 A * 11/1994 Benevento et al. ..... 2/181.4
5,469,579 A * 11/1995 Tremblay et al. ..... 2/7
5,715,533 A * 2/1998 Stein ..... 2/7
6,050,099 A * 4/2000 Lopa et al. ..... 62/259.3
6,681,590 B1 * 1/2004 Jones ..... 62/259.3
6,711,748 B1 * 3/2004 Paris et al. ..... 2/171.3
6,715,309 B1 * 4/2004 Junkins ..... 62/259.3
6,760,925 B1 * 7/2004 Maxwell ..... 2/171.3
6,792,624 B1 * 9/2004 Simmons ..... 2/209.13
7,010,931 B1 * 3/2006 Lee ..... 62/259.3

FOREIGN PATENT DOCUMENTS

FR 2647645 A1 * 12/1990

* cited by examiner

*Primary Examiner*—Mohammad M. Ali
(74) *Attorney, Agent, or Firm*—Leong C. Lei

(57) ABSTRACT

A headgear capable of sprinkling and cooling comprises at least a crown, a water pouch and a liquid dispenser. The front end of the peak is provided with an atomizing nozzle, which is connected with a connecting tube at one end. A water pouch provided at the inner rim of the crown is provided with a water outlet at the outer edge. The liquid dispenser includes a squeezing device, a switch, and batteries; all of the above elements are assembled and contained in a casing composed of an upper portion and a lower portion, and then installed at an upper position of the peak. The liquid dispenser is connected to the water outlet of the water pouch with its inlet end, and to the nozzle with its outlet end via a connecting tube. Accordingly, the water contained in the pouch can be transmitted by the liquid dispenser to the nozzle at the front end of the peak for praying purpose, thereby accomplishing a headgear capable of sprinkling and cooling.

6 Claims, 15 Drawing Sheets

HEADGEAR CAPABLE OF SPRINKLING AND COOLING

BACKGROUND OF THE INVENTION (a) Technical Field of the Invention

The present invention relates to a headgear capable of sprinkling and cooling, particularly to a headgear which is serviceable as more than a headgear for worn by the user, but also can have the effect of sprinkling and cooling, thereby allowing the user much more comfort during use.

(b) Description of the Prior Art

Nowadays, outdoor sports are popular with the public. And, people are used to wearing headgear while taking exercise or conducting leisure activities for sunshade purposes. Although conventional leisure headgear has a peak for sunshade purposes, in case the heat vaporized from the user's face cannot be cooled off, the user might still sweat and feel uncomfortable.

In view of the above, the inventor has researched to develop the disadvantages existing in the prior art, and disclosed the present invention in an attention to profit the consumers.

SUMMARY OF THE INVENTION

The primary purpose of the present invention is to provide a headgear capable of sprinkling and cooling, in which the water can be transmitted via a liquid dispenser to a nozzle at the front end of the peak for spraying on the user's face to cool off the heat, thereby the headgear not only can serve as a leisure headgear, but also can have the effect of sprinkling and cooling.

To obtain the above objects, the invention relates to a headgear capable of sprinkling and cooling, which is provided with at least a crown, a water pouch and a liquid dispenser. The front end of the peak is provided with an atomizing nozzle, which is connected with a connecting tube at one end. A water pouch provided at the inner rim of the crown is provided with a water outlet at the outer edge. A liquid dispenser includes a squeezing device, a switch, and batteries; all of the above elements are assembled and contained in a casing composed of an upper portion and a lower portion, and then installed at an upper position of the peak. The liquid dispenser has an inlet end at its side and an outlet end at its bottom. While the inlet end is connected to the water outlet of the water pouch, the outlet end is connected to the nozzle via a connecting tube. Accordingly, the water contained in the pouch can be transmitted through the liquid dispenser to the nozzle at the front end of the peak for praying purpose, thereby accomplishing a leisure headgear capable of sprinkling and cooling.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
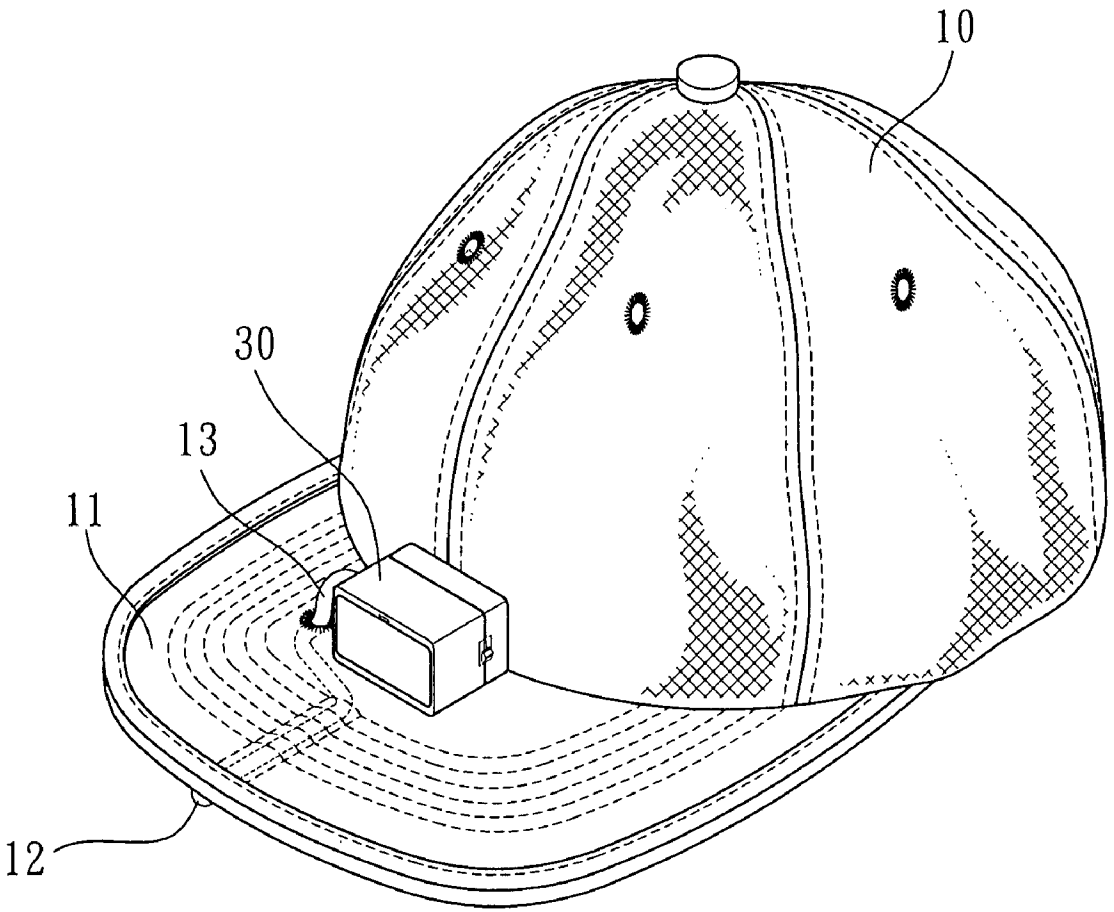
FIG. 1 is a perspective view of the present invention.
Figure 2:
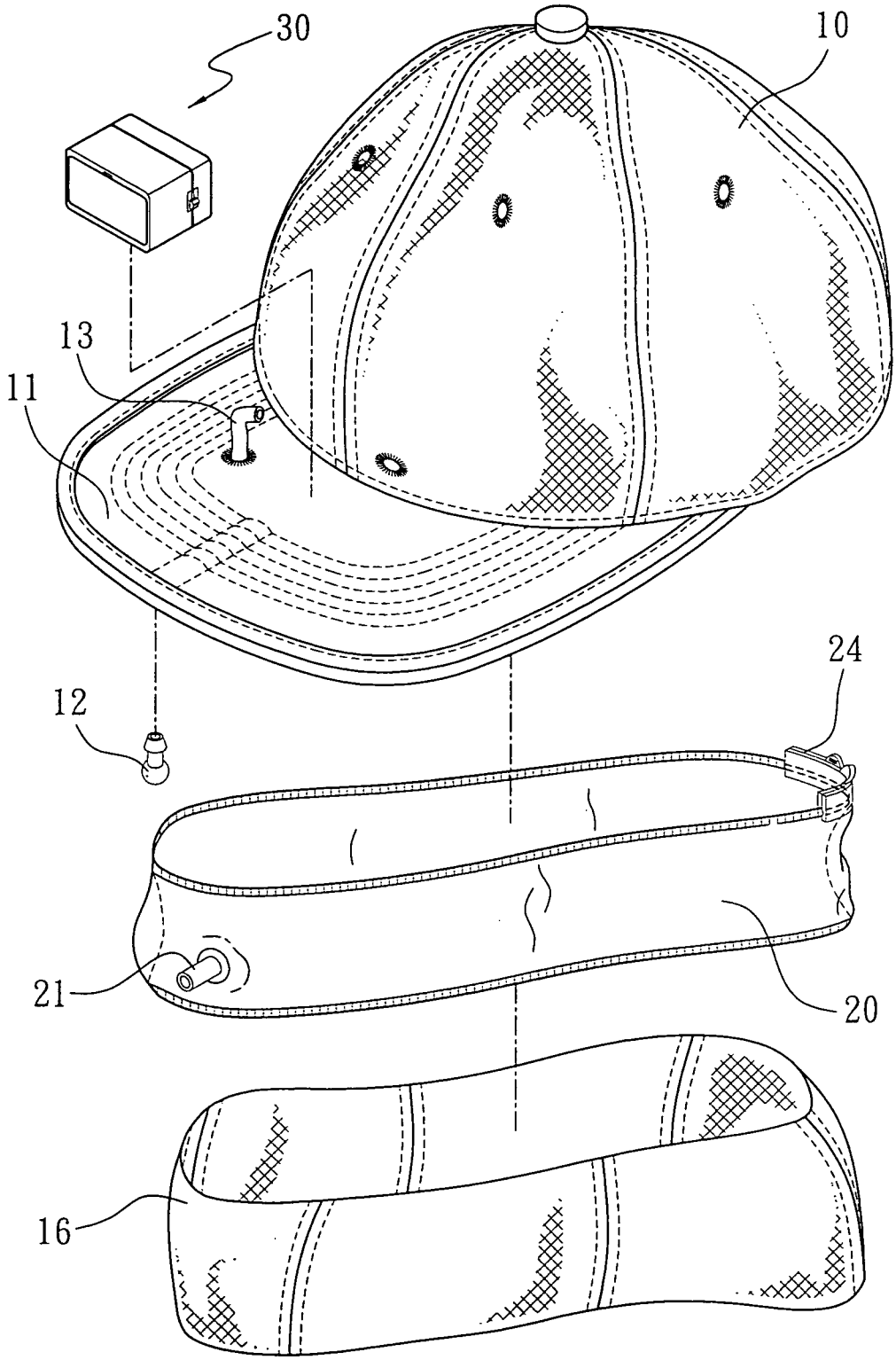
FIG. 2 is an exploded view of the invention.
Figure 14:
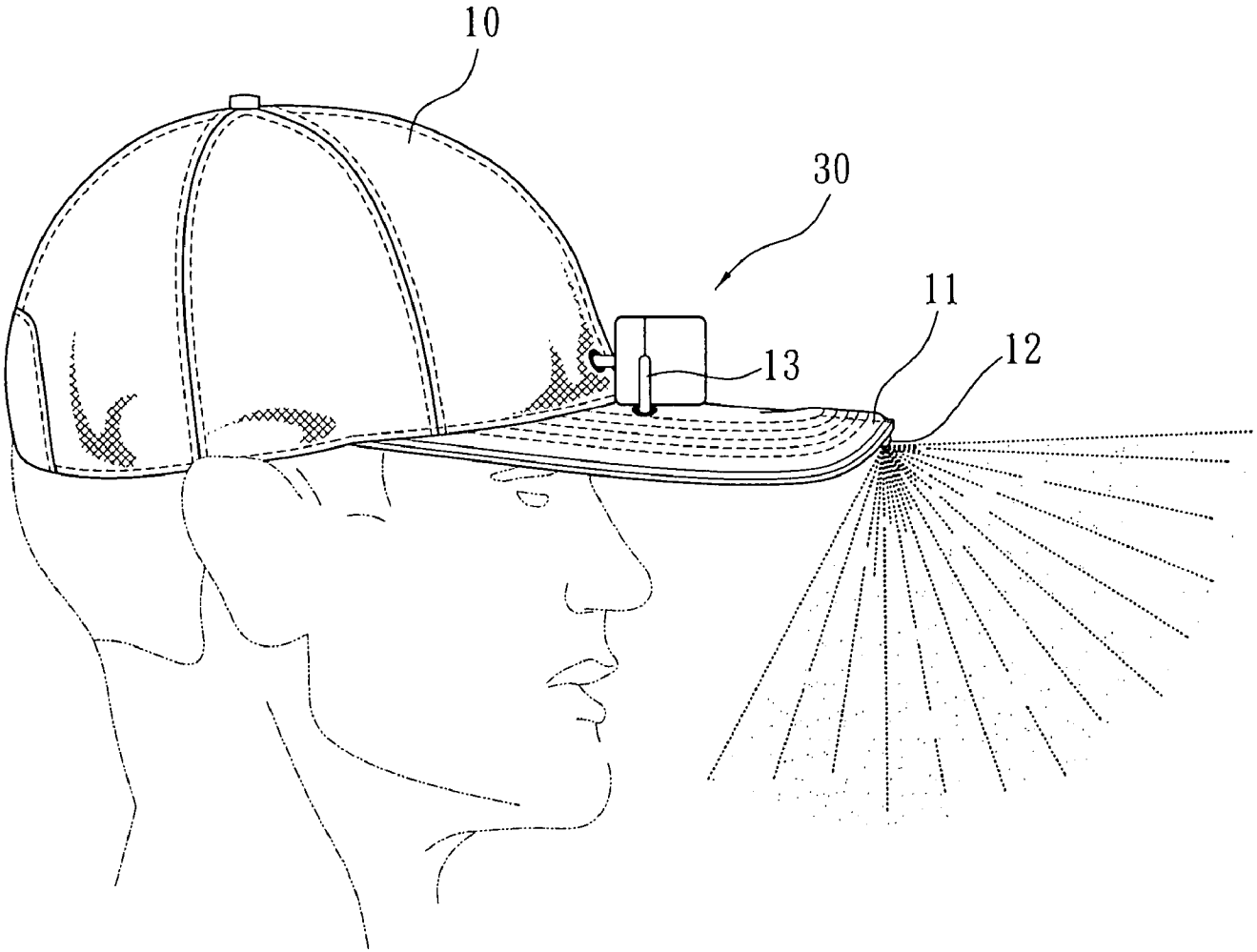
FIG. 14 shows the use status of the invention.

As shown in FIGS. 1 and 2, a headgear capable of sprinkling and cooling is composed of a crown 10, a water pouch 20 and a liquid dispenser 30. The water contained in the pouch 20 can be transmitted via the liquid dispenser 30 to a nozzle 12 at the front end of the peak 11 for spraying on the front of the user's face (as shown in FIG. 14), thereby the water molecules can instantly cool off the heat on the user's face.

Figure 3:
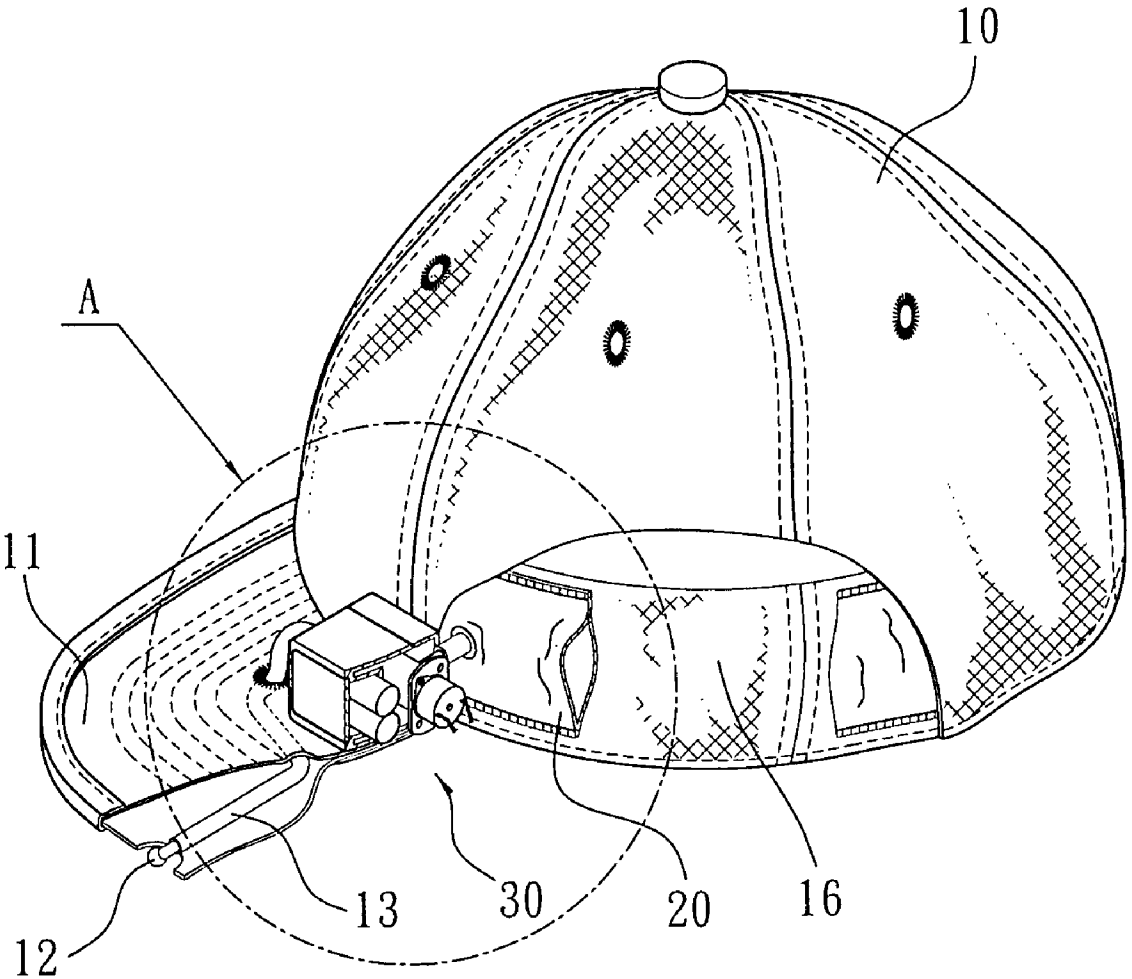
FIG. 3 is a cut-away view of the invention.
Figure 3A:
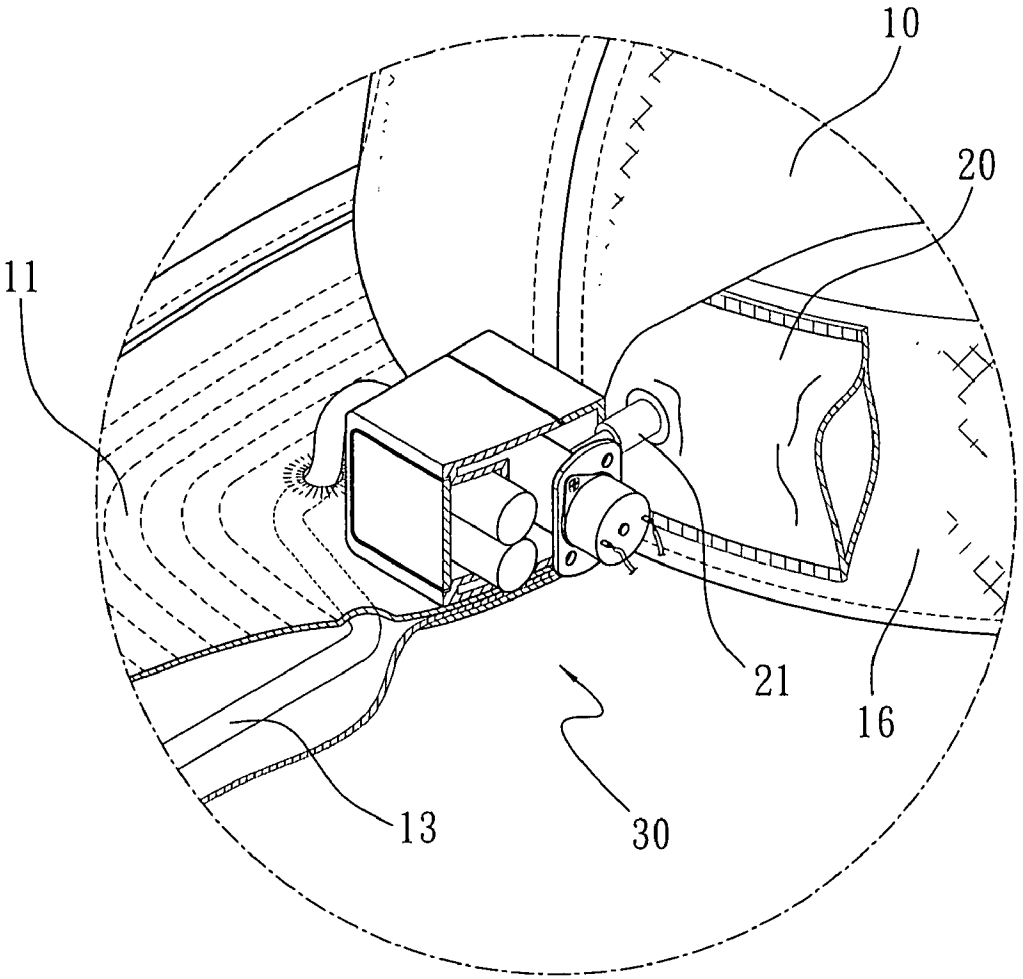
FIG. 3A is a partially enlarged view taken from FIG. 3.
Figure 4:
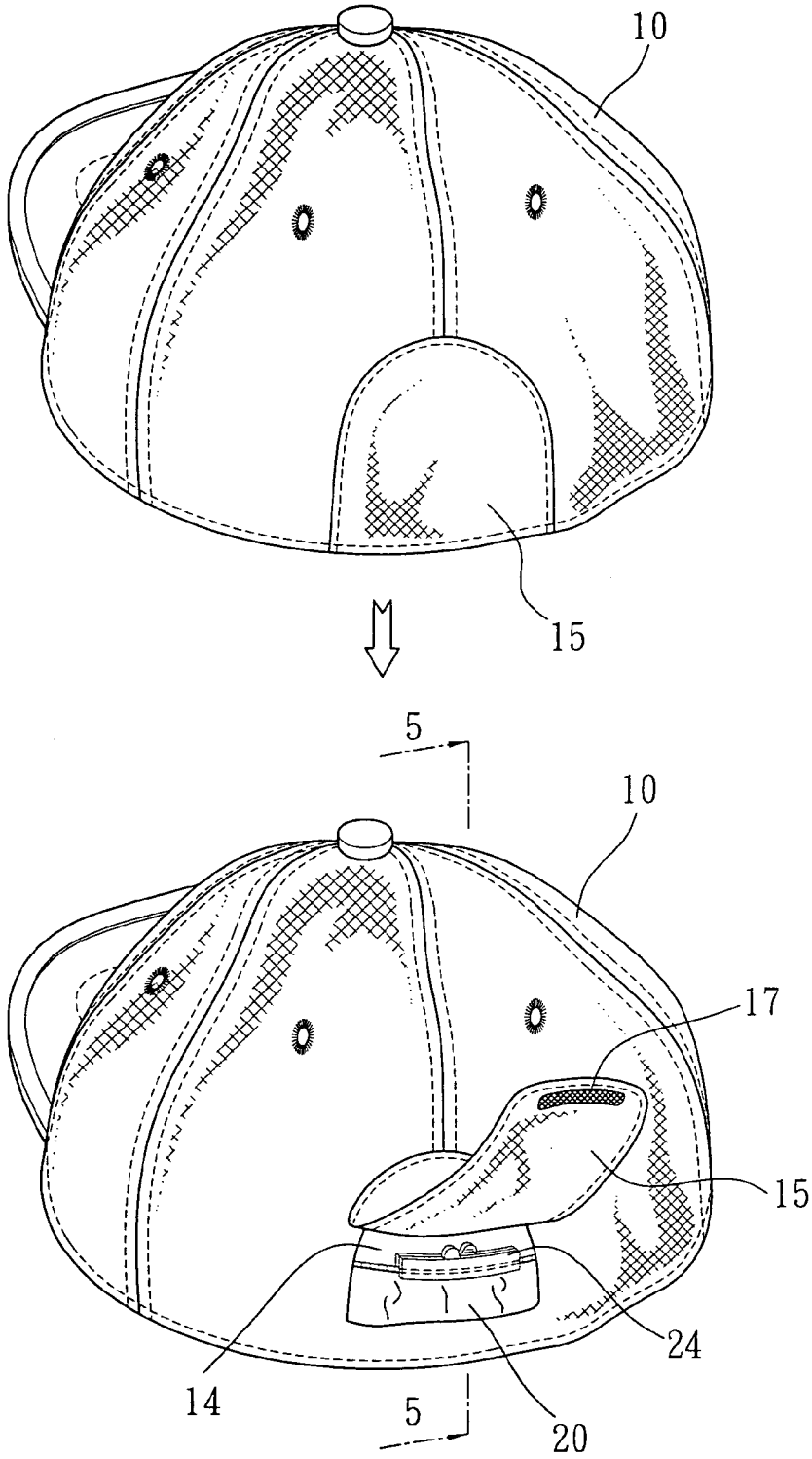
FIG. 4 is a rear view of the invention showing the shade cloth.

Referring to FIGS. 3, 3A and 4, said crown 10 is provided with a nozzle 12 at the front end of the peak 11. The nozzle 12 is connected to the liquid dispenser 13 via a connecting tube 13. The rear end of the crown 10 is provided with an opening 14, above which is provided with a shade cloth 15 (as shown in FIG. 4). The shade cloth 15 is sewn with a magic tape (Velcro), while the inner rim of the crown 10 is sewn with a sweatband 16, thereby a reservoir is formed inside the crown 10 for receiving the water pouch 20 (as shown in FIGS. 5 and 6).

Figure 5A:
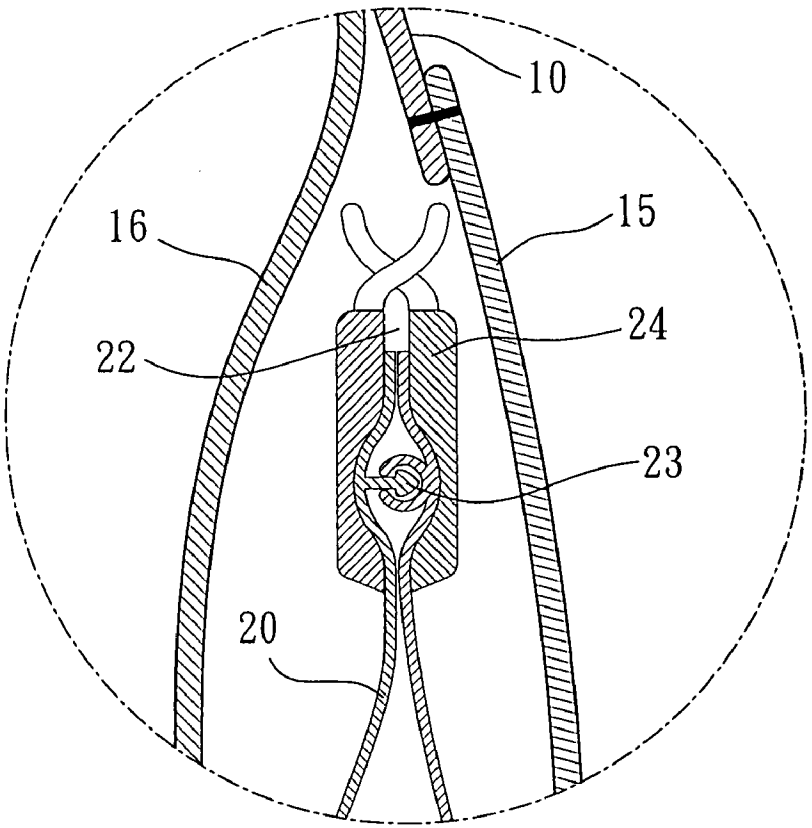
FIG. 5A is a partially enlarged view taken from FIG. 5.
Figure 5:
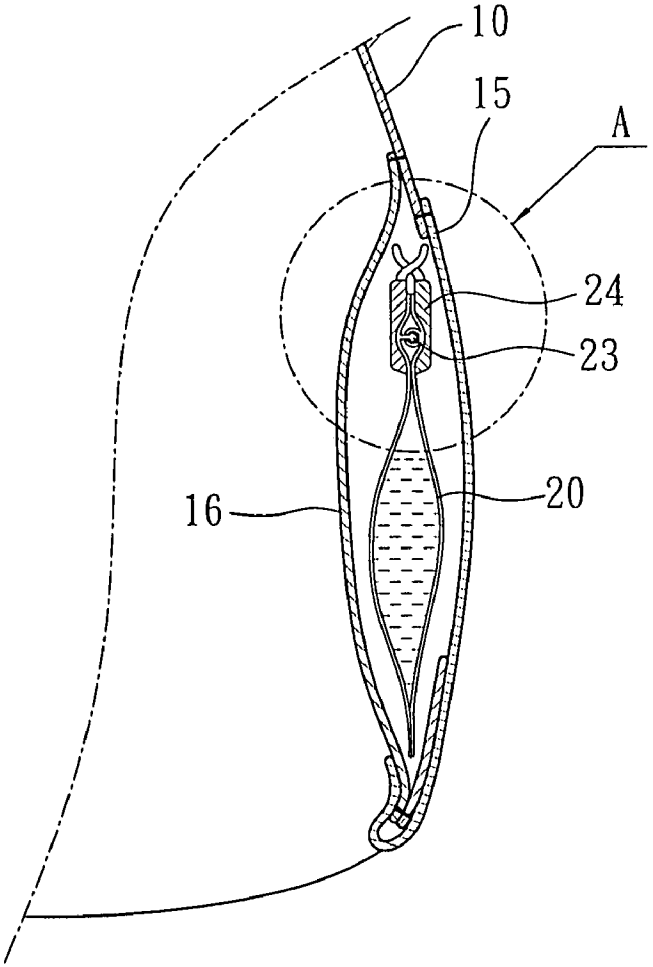
FIG. 5 is a partially enlarged view of the rear portion of the invention.

As shown in FIGS. 3A, 4 and 5A, the outer edge of the water pouch 20 is provided with a water outlet 21, which is connected to the liquid dispenser 30 (as shown in FIG. 3A), whereas the top end rim of the water pouch 20 is provided with a water inlet 22 which is corresponding to the opening 14 of the crown 10. The water inlet 22 is provided with a water-proof zipper 23 inside, and a pressure plate 24 outside (as shown in FIG. 5A).

Figure 6:
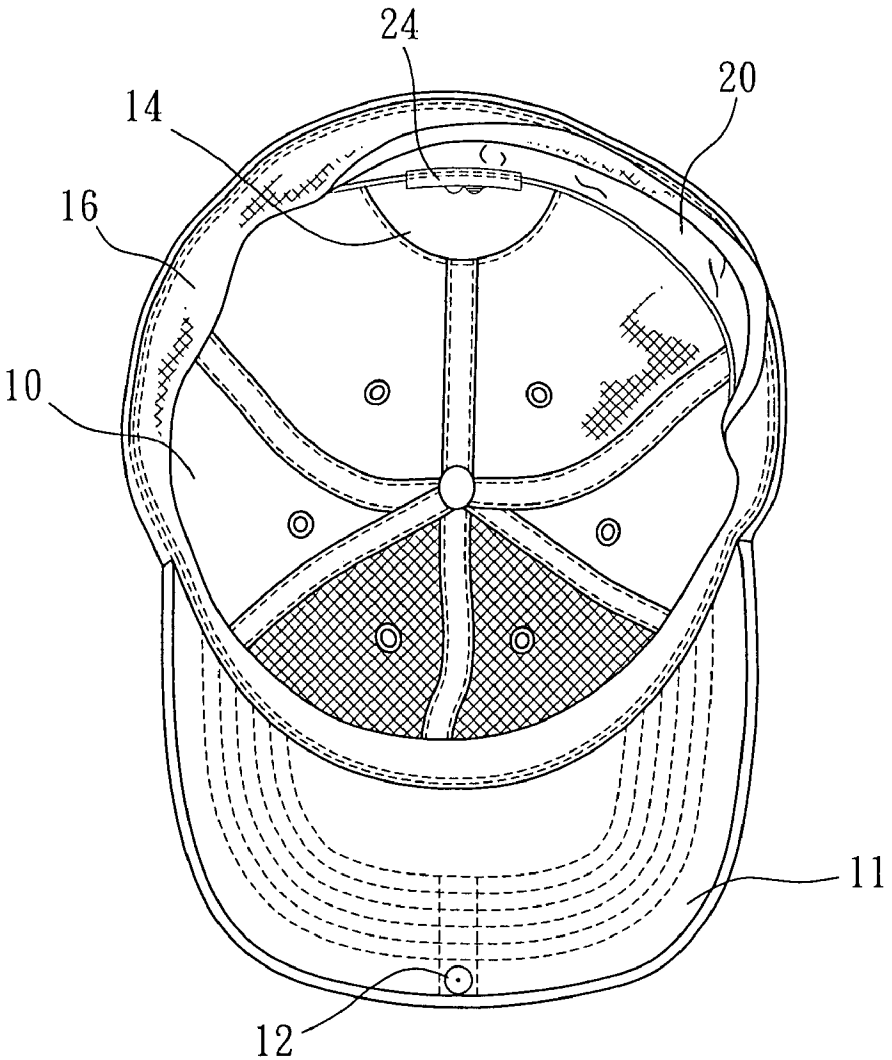
FIG. 6 is a bottom view of the invention.
Figure 7:
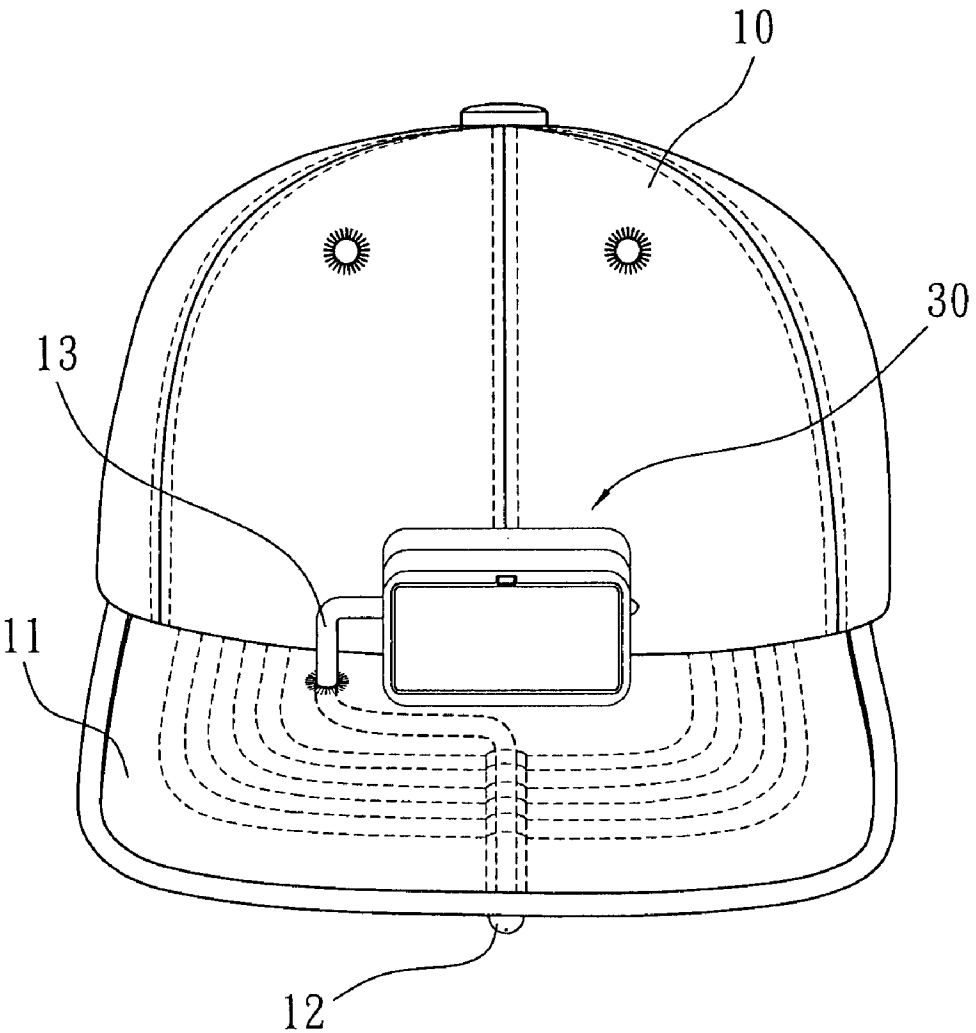
FIG. 7 is a front view of the invention.

As shown in FIGS. 6 and 7, the headgear according to the invention has a conventional appearance. However, the water pouch 20 is invisibly hidden inside of the sweatband 16 of the headgear. The provision of the liquid dispenser 30 at the front end of the headgear can ease exchange of batteries.

Figure 8:
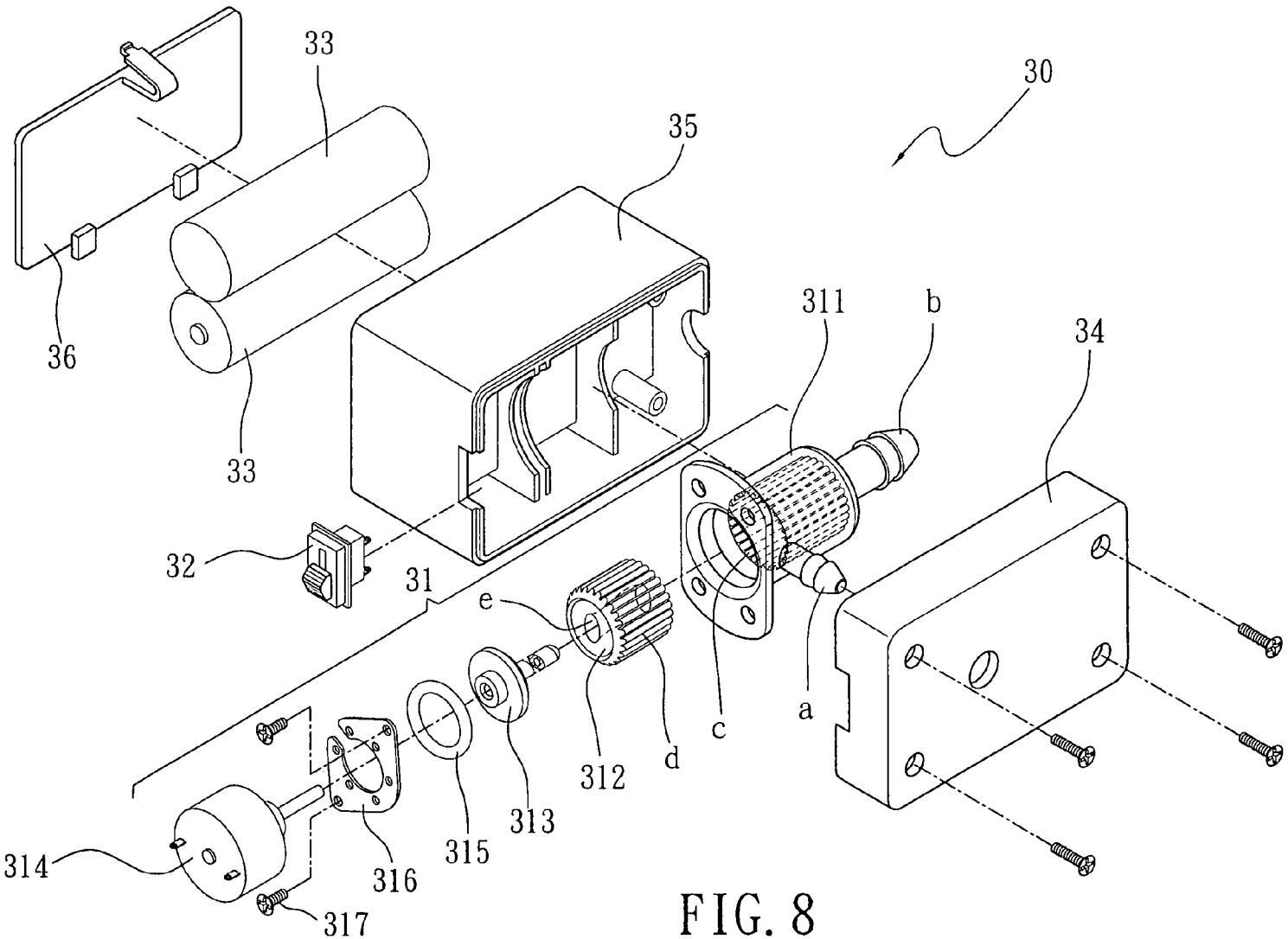
FIG. 8 is an exploded view of the liquid dispenser according to the invention.
Figure 9:
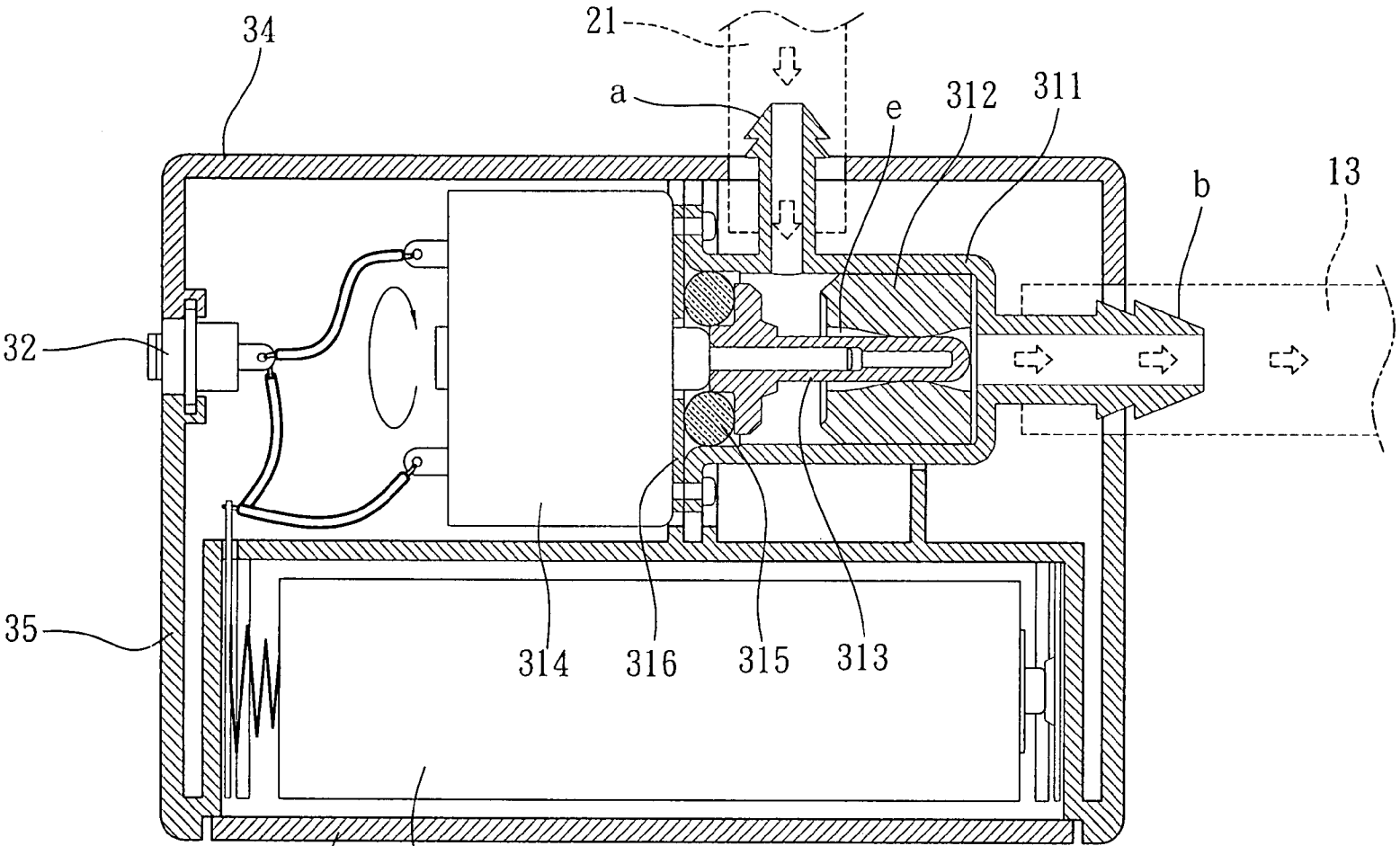
FIG. 9 is a cut-away view of the liquid dispenser according to the invention.

Now referring to FIGS. 8 and 9, the liquid dispenser 30 includes a squeezing device 31, a switch 32 and batteries 33. The squeezing device 31 is installed inside of a casing composed of an upper portion 34 and a lower portion 35 with an inlet end a and an outlet b exposed out of the upper casing and the lower casing, respectively. The batteries 33 are installed in the battery chamber of the lower casing 35 and fastened by a batter cover 36. A switch 32 is installed at the outer edge of the casing. The liquid dispenser 30 is installed above the peak 11 (as shown in FIG. 3) with the inlet end a connected with the water outlet 21 of the water pouch 20, and the outlet end b connected with the nozzle 12 via the connecting tube 13. The squeezing device 31 inside of the liquid dispenser 30 is controlled by the switch 32, such that the water contained in the pouch 20 can be transmitted to the nozzle 12 at the front end of the peak 11 for sprinkling purpose.

The above-mentioned squeezing device 31 is basically composed of a base 311, a gasket 312, a squeezing stick 313 and a motor 314. The base 311 is in form of a hollow body which is provided with positioning grooves c on the wall of the hollow portion. The side and bottom of the base 311 is connected with the inlet end a and the outlet end b, respectively. The periphery of the gasket 312 is provided with positioning ratchets d corresponding to the positioning grooves c. While the gasket 312 is combined and fastened to the hollow portion of the base 311, an oval threaded hole e goes through the gasket 312 for receiving the squeezing stick 313 having an oval cross-sectional core bar, such that the oval cross-sectional core bar may interferentially cooperate with the hole e. The axis of the motor 314 is engaged in another end of the squeezing stick 313. While an o-ring 315 and a leak-proof washer 316 are provided between the gasket 312 and the motor 314, the leak-proof washer 316 is combined with the base 311 by way of screws 317. Accordingly, the motor 314 drives the squeezing stick 313 to rotate, and gaps between the oval cross-sectional core bar of the squeezing stick 313 and the hole e of the gasket 312 will transmit during the rotation, thereby generating a pumping effect to drive the liquid.

Figure 10:
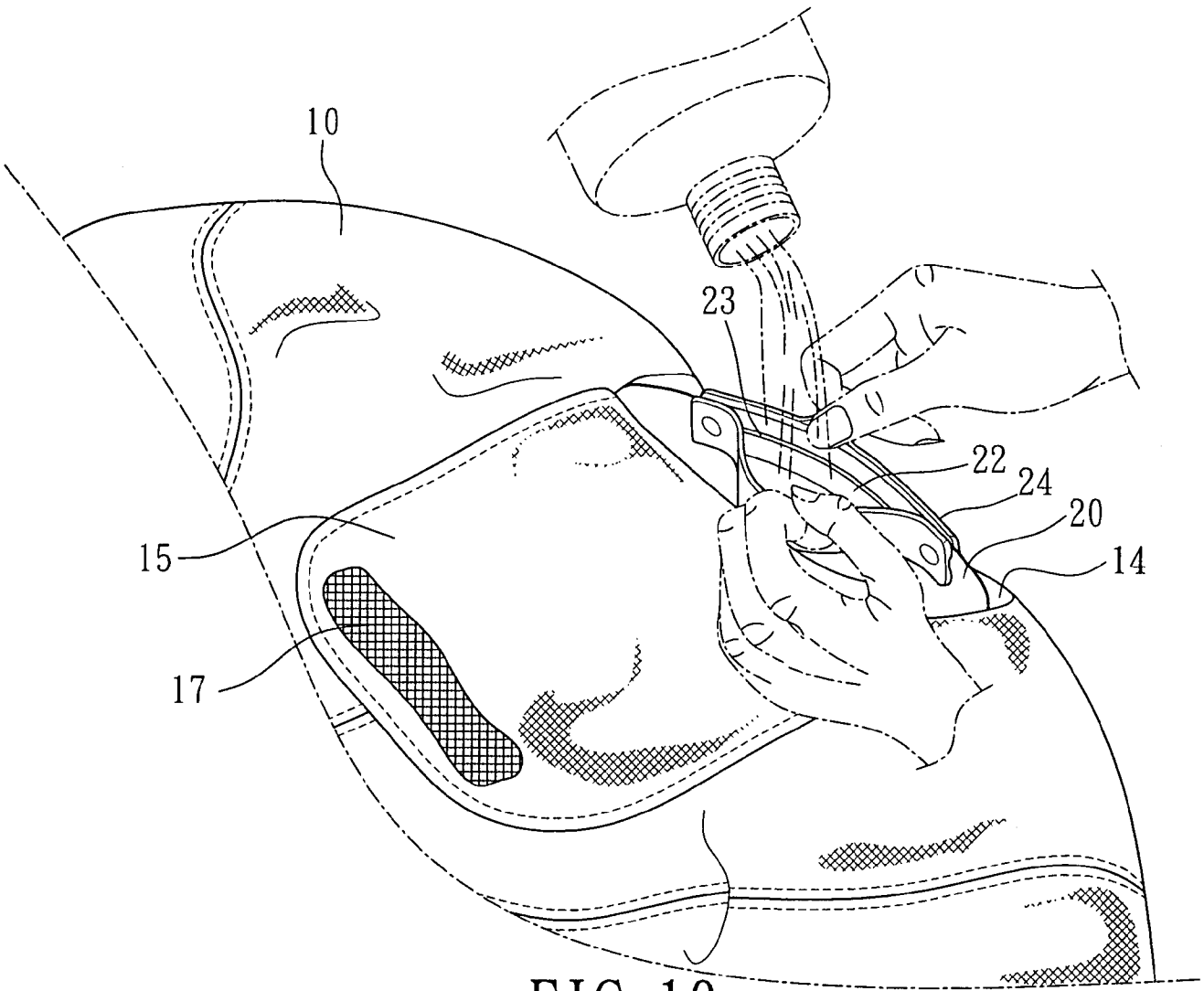
FIG. 10 shows the status of filling water to the invention.

As shown in FIGS. 4 and 10, when filling water, the shade cloth 15 at the rear of the headgear 10 is lifted, the pressure plate 24 of the water pouch 20 is opened, and the water inlet 22 of the pouch 20 is disclosed, so that the water can be pulled into the water inlet 22 to fill up the pouch 20.

Figure 11:
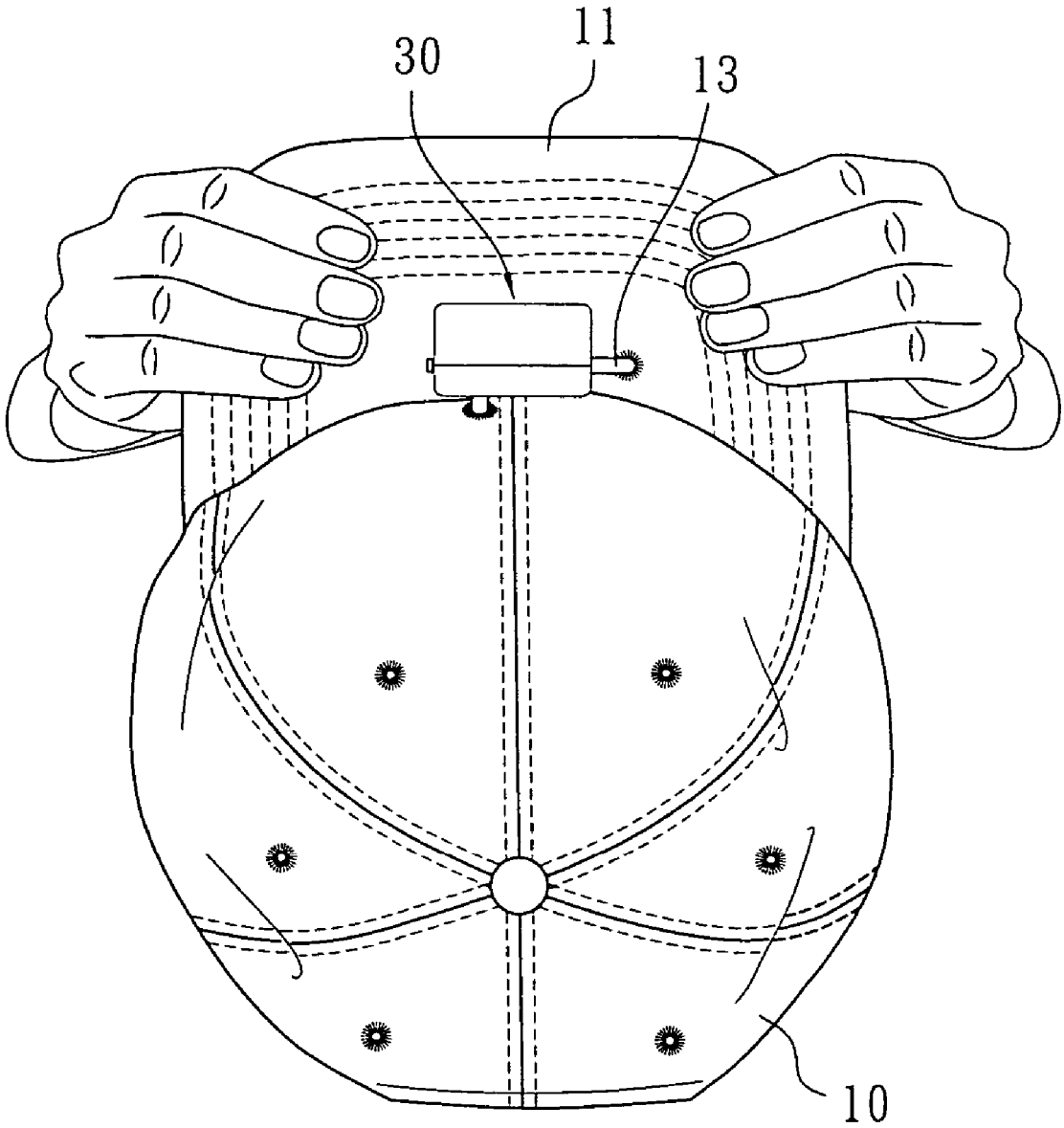
FIG. 11 is a top view showing use of the invention.
Figure 12:
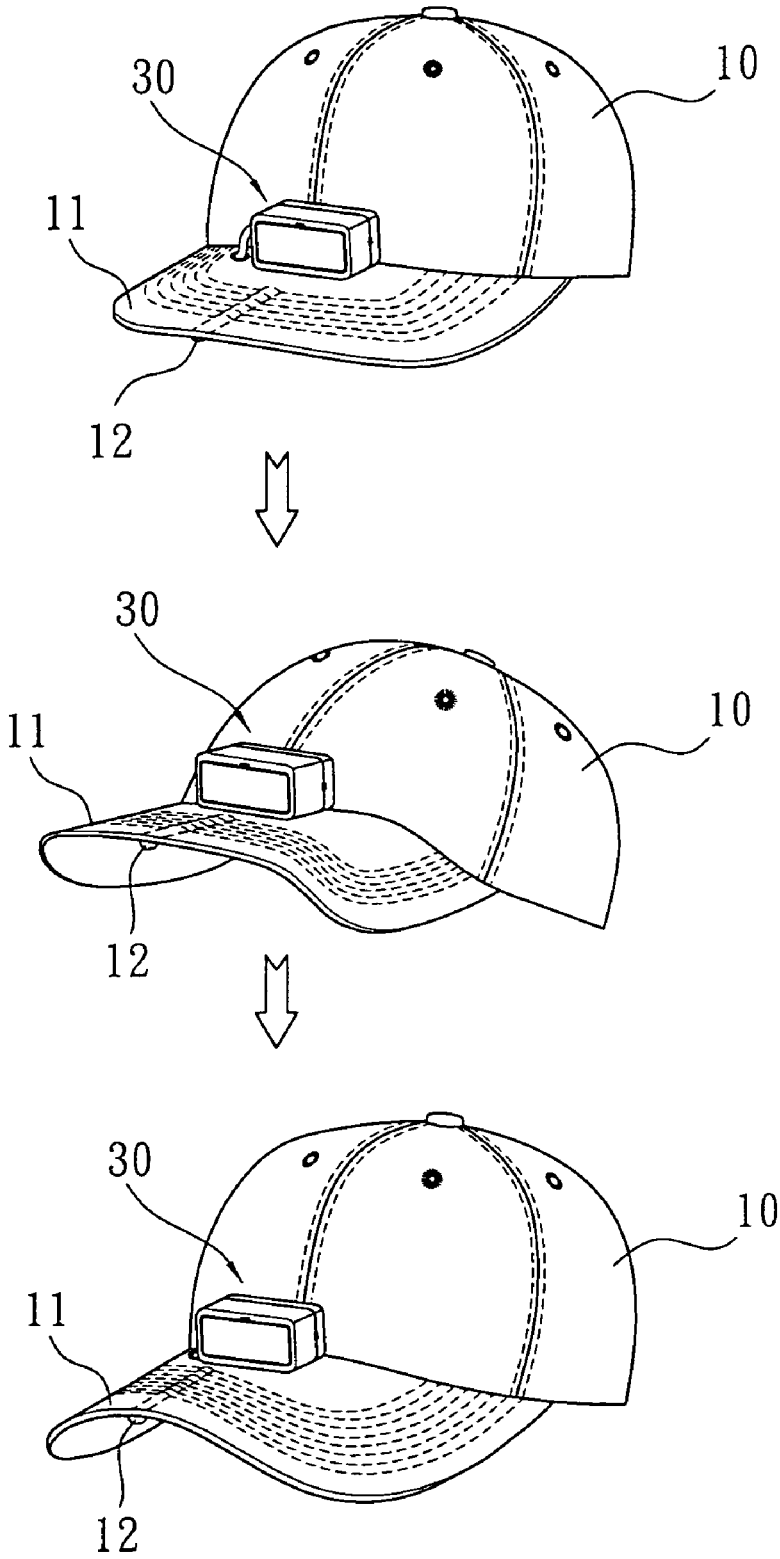
FIG. 12 is a perspective view of the invention showing that the peak is adjustable.

As shown in FIGS. 11 and 12, the liquid dispenser 30 according to the invention is installed above the peak 11. Nevertheless, the liquid dispenser 30 can be alternatively applied to a transformable peak without adversely affect the function thereof at the time when the peak is bended to change its angle.

Figure 13:
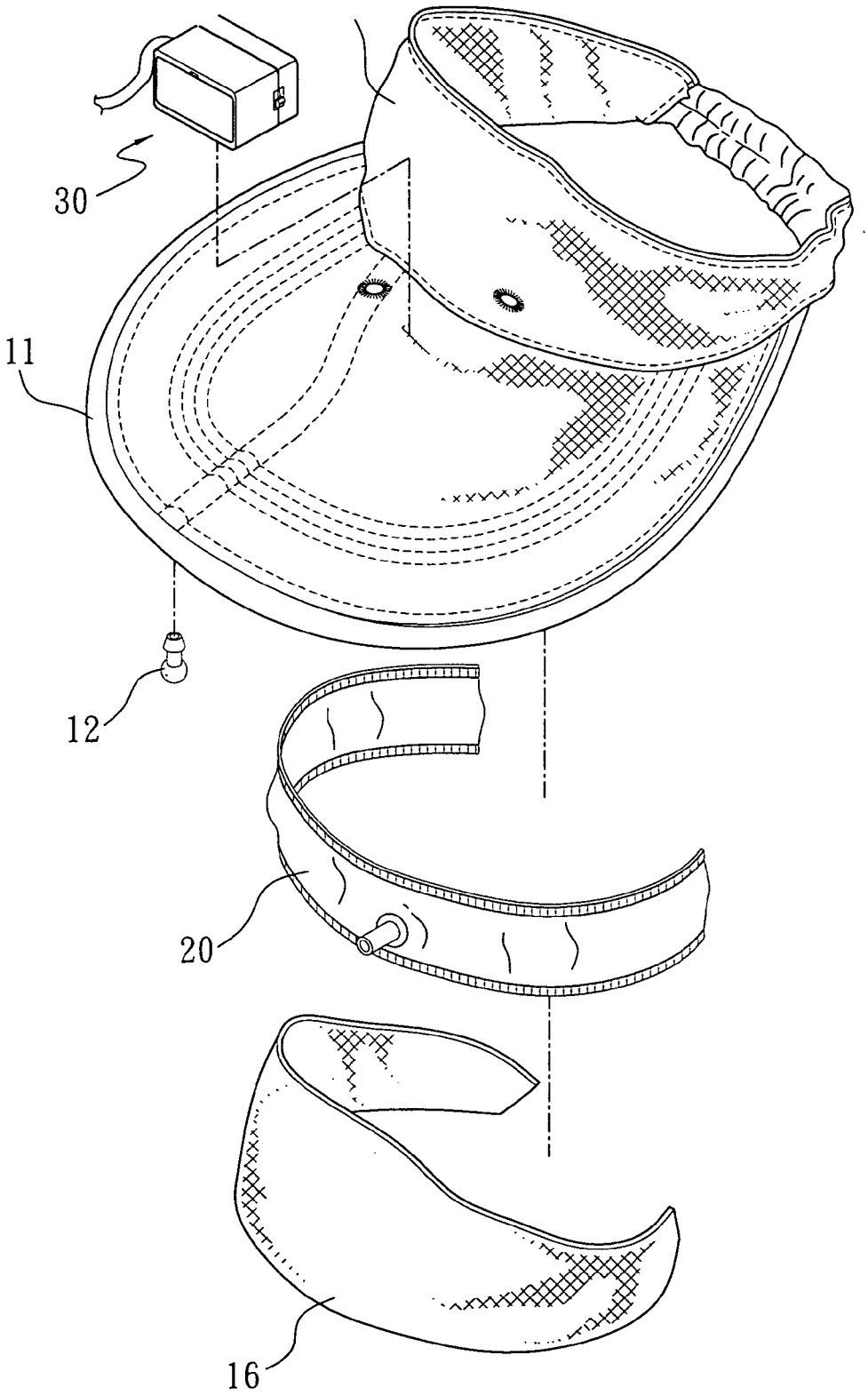
FIG. 13 is an exploded view of another embodiment of the invention.

Referring to FIG. 13, based on the design and conception of the present invention, the water pouch 20, liquid dispenser 30 and nozzle 12 can be combined with various headgears, such as a tennis sun visor 10 as shown, which is interiorly provided with a sweatband 16, such that the water pouch 20 can be hidden between the sweatband 16 and the crown 10, and the water contained in the pouch 20 can be transmitted by the liquid dispenser 30 to the nozzle 12 at the front end of the peak 11 for the purpose of sprinkling.

Concluded above, the headgear according to the invention can permit the water to be transmitted by a liquid dispenser to the atomizing nozzle at the front end of the peak for spraying onto the user's face, thereby cooling off the heat. As such, the invention can allow conventional leisure headgear a better cooling effect.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A headgear capable of sprinkling and cooling, comprising at least a crown having a front end, a rear end, a peak and an inner rim;

a water pouch having an outer edge, and an upper edge and a liquid dispenser, characterized in that:

the front end of the peak connected to the crown is provided with an atomizing nozzle, which has a connecting tube at one end;

the water pouch provided at the inner rim of the crown is provided with a water outlet at the outer edge, and a water inlet at the upper edge; and the liquid dispenser includes a squeezing device, a switch, and batteries; all of the above elements are assembled and contained in a casing composed of an upper portion and a lower portion, and installed at an upper position of the peak.

2. The headgear capable of sprinkling and cooling according to claim 1, wherein the rear end of the crown is provided with an opening, above which is sewed with a shade cloth having a magic tape (Velcro).

3. The headgear capable of sprinkling and cooling according to claim 1, wherein the inner rim of the crown is provided with a sweatband, which partitions off a reservoir.

4. The headgear capable of sprinkling and cooling according to claim 1, wherein inside of the water inlet of the water pouch is provided with a water-proof zipper.

5. The headgear capable of sprinkling and cooling according to claim 4, wherein the water-proof zipper is covered by a pressure plate.

6. The headgear capable of sprinkling and cooling according to claim 1, wherein the headgear can be any kind of sports and leisure caps, including baseball caps, tennis caps, etc.

* * * * *